US005226364A

United States Patent [19]

Fadner

[11] Patent Number: 5,226,364

[45] **Date of Patent: * Jul. 13, 1993**

[54] ULTRASONIC INK METERING FOR VARIABLE INPUT CONTROL IN LITHOGRAPHIC PRINTING

[75] Inventor: Thomas A. Fadner, LaGrange, Ill.

[73] Assignee: Rockwell International Corporation, El Segundo, Calif.

[ * ] Notice: The portion of the term of this patent subsequent to Jun. 16, 2009 has been disclaimed.

[21] Appl. No.: 886,548

[22] Filed: May 20, 1992

Related U.S. Application Data

[63] Continuation of Ser. No. 676,053, Mar. 27, 1991, Pat. No. 5,121,689.

[51] Int. Cl.[5] ..... B41F 31/04; B41F 31/08; B41L 27/06

[52] U.S. Cl. ..... 101/366; 101/450.1

[58] Field of Search ..... 101/350, 363, 365, 366, 101/207, 208–210, 148, 450.1, 452; 118/620, 639, 261; 15/256.5; 366/127, 600

[56] References Cited

U.S. PATENT DOCUMENTS

| | | | |
|---|---|---|---|
| 3,087,184 | 4/1963 | Ljungquist | 101/169 |
| 3,113,225 | 12/1963 | Kleesattel et al. | 101/169 |
| 3,389,655 | 6/1968 | Lorenz et al. | 101/169 |
| 3,964,386 | 6/1976 | Dini | 101/169 |
| 5,054,392 | 10/1991 | Greenwood | 101/169 |
| 5,121,689 | 6/1992 | Fadner | 101/365 |

FOREIGN PATENT DOCUMENTS

| | | | |
|---|---|---|---|
| 797912 | 5/1978 | U.S.S.R. | 101/169 |

*Primary Examiner*—J. Reed Fisher
*Attorney, Agent, or Firm*—C. B. Patti; V. L. Sewell; H. F. Hamann

[57] ABSTRACT

An ultrasonic printing fluid input apparatus and method for use in a lithographic printing press. The system has a rotatable roller 20 having at least an oleophilic and hydrophobic surface and a source 100 of printing fluid. A metering blade 62 for applying a thin film of printing fluid to the surface of the metering roller 20 has at least one device 63 for imparting ultrasonic vibrations to the metering blade 62 such that a thickness of the thin film of printing fluid is a function of the amplitude of ultrasonic vibrations. A control 65 for varying the amplitude of ultrasonic vibrations is connected to the device 63 for imparting ultrasonic vibrations. A fixed end of the metering blade 62 is attached to a stationary support 42 via a decoupling material 65. An printing fluid removal device 73 is also provided for substantially removing a return printing fluid film on the oleophilic and hydrophobic surface of the metering roller 20.

3 Claims, 10 Drawing Sheets

ULTRASONIC INK METERING FOR VARIABLE INPUT CONTROL IN LITHOGRAPHIC PRINTING

This is a continuation of application Ser. No. 676,053, filed Mar. 27, 1991, now U.S. Pat. No. 5,121,689, issued Jun. 16, 1992.

BACKGROUND OF THE INVENTION

The present invention relates to printing fluid input systems for use in keyless lithographic printing processes.

In the field of high speed lithographic printing, ink is continuously conveyed from an ink source by means of a series of rollers to planographic printing plate on a plate cylinder in a lithographic printing press. Image portions of the printing plate accept ink from one or more of the last of a series of inking rollers and transfer a portion of that ink to a blanket cylinder as a reverse image from which a portion of the ink is transferred to form a correct-reading image on paper or other materials. It is also essential in conventional lithographic printing processes that a dampening solution containing water and proprietary additives be conveyed continuously to the printing plate whereby transferring in part to the non-image areas of the printing plate the water functions to keep those non-image areas free of ink. Hereinafter, the terms "water" and "dampening solution" refer to water plus additives or to other aqueous solutions used in the operation of lithographic printing presses.

In conventional printing press systems, the ink is continuously made available in varying amounts determined by cross-press column input control adjustments to all parts of the printing plate, including both image and non-image areas. In the absence of the dampening solution, the printing plate will accept ink in both the image and non-image areas of its surface.

Lithographic printing plate surfaces in the absence of imaging materials have minute interstices and a hydrophilic or water-loving property to enhance retention of water, that is the dampening solution, rather than ink on the surface of the plate. Imaging the plate creates oleophilic or ink-loving areas according to the image that is to be printed. Consequently, when both ink and dampening solution are presented to an imaged plate in appropriate amounts, only the ink tending to reside in non-image areas becomes disbonded from the plate. In general, this action accounts for the continuous ink and dampening solution differentiation on the printing plate surface, which is essential and integral to the lithographic printing process.

Controlling the correct amount of dampening solution supplied during lithographic printing has been an industry-wide problem ever since the advent of lithography. It requires continual operator attention since each column adjustment of ink input may require a change in dampener input. Balancing the ink input that varies for each column across the width of the press with more or less uniform dampening solution input across the width of the press is at best a compromise. Consequently, depending upon which portion of the image the operator has adopted a his standard of print quality at any given time during the printing run, the operator may need to adjust the ink input at correspondingly-located cross-press positions. As a result, the dampening solution to ink ratio at that position ma become changed from a desired value. Conversely, the operator may adjust the dampener input for best ink and dampening solution balance at one inking column, which may adversely affect the ink and dampening solution balance at one or more other cross-press locations. Adjustments such as these tend to occur repeatedly throughout the whole press run, resulting in slight to significant differences in the quality of the printed image throughout the run. In carrying out these adjustment operations, the resulting images may or may not be commercially acceptable, leading to waste in manpower, materials, and printing machine time.

Certain commercially successful newspaper printing configurations rely on the inking train of rollers to carry dampening solution to the printing plate. Notable among these are the Goss Metro, Goss Metroliner, and the Goss Headliner Offset printing presses which are manufactured by the Graphic Systems Division of Rockwell International Corporation. In these alternative configurations, the dampening solution is combined with the ink on an inking oscillator drum such that both ink and water are subsequently and continuously transferred to the inking form rollers for deposition onto the printing plate. In another variation, the dampening solution is applied in a conventional manner directly to the printing plate by means of separate dampening rollers and a dampening solution supply system. In systems of either type, regardless of the method whereby the dampening solution is introduced, it is well known that some of the dampening solution becomes mixed with the ink near and at the plate surface and returns to the inking train of rollers and may ultimately be introduced into the ink supply system itself. In any case, these conventional lithographic systems require considerable operator attention to maintain ink and dampening solution balance and produce more product waste than desired.

Prior art devices and methods for correcting this inherent fault in conventional lithography utilize keyless inkers. Certain of these methods also involve eliminating the dampening system or eliminating operator control of the dampening system.

Keyless inking systems have been disclosed that purport to eliminate operator attention to column control of inking by elimination of adjustable inking keys, thereby avoiding many of the aforementioned disadvantages of conventional lithography. For keyless inking systems an ink metering method is required that continues to function despite the presence of up to about 40% dampening solution in the ink without allowing any temporarily-free dampening solution to interfere with the ink-metering function. Also, the unused or non-uniform portion of the initially uniform ink film that is being continuously presented to the printing plate must be continuously scraped-off the return side of the inking system to enable continuous presentation of the uniform ink film to the plate by the supply side of the inking system. This scraped-off film is not uniform across the width of the press in ink and dampening solution composition. Since it would not be economically feasible to continuously discard the ink in the unused portion of the ink and dampening solution mixture, this mixture must either be renewed by selectively removing dampening solution from the mixture and returning the ink portion to the inking system or by thoroughly intermixing the unused ink and dampening solution mixture with fresh replenishment ink and returning such mixture to the inking system. U.S. Pat. No. 4,690,055 discloses a keyless inking system in which dampening solution removal is unnecessary and which accommodates the dampening solution that is naturally acquired in the unused ink during the practice of lithography and for which, therefore, removal of dampening solution is not required.

In the keyless inking system disclosed in U.S. Pat. No. 4,690,055 (hereby incorporated by reference), the location of the dampening system is not critical and can be positioned either to supply dampening solution directly to the plate cylinder or at some other location such as at an oscillator drum to which ink is also being supplied. An ink circulating and mixing system receives new or replenishment ink, as well as, the ink and dampening solution combination, that is continuously returned from a doctor blade which scrapes excess printing fluid from a rotating metering roller. Such ink and dampening combinations are generally herein referred to as printing fluids. The printing fluid circulating and mixing system functions to assure an inherently uniform cross-press input of printing fluid that remains consistent throughout a printing run and consists of a printing fluid pan roller, pump and appropriate conduits, a printing fluid pan level controlling system, and a printing fluid reservoir of such volume and design that it assures the printing fluid being fed to the metering roller is uniform in composition at any given instant of time despite the existence of the continual cross-press dampening solution to ink ratio differences of the unused or scraped return printing fluid previously referred to. The printing fluid circulation system is designed to continuously collect and distribute the printing fluid from a reservoir through a plenum or series of orifices to uniformly redistribute the printing fluid across the press width to provide uniform composition of the printing fluid that is being introduced to a celled metering roller. The metering roller can be one of the types shown and described in U.S. Pat. Nos. 4,882,990, 4,537,127, 4,862,799, 4,567,827, or 4,601,242, (all of which are hereby incorporated by reference) or any wear resistant oleophilic and hydrophobic metering roller as substantially therein defined.

Although the system disclosed in U.S. Pat. No. 4,690,055 provides great improvements in lithographic printing presses, the technology provides only a fixed volume of ink input. In this prior art system the return ink film is removed in sequence after the metering roller surface has been refilled with replacement printing fluid by means of a single doctoring blade. Other prior art systems use two doctor blades, the first in sequence removing the return unused ink film, the second next in sequence removing excess refill ink that had been purposefully applied to assure complete filling of the metering roller cells. None of these prior art inking systems have proven means for purposefully varying the amount of ink being metered into the press in a manner that is uniform across the width of the press.

With flexographic or gravure keyless inking system which use highly fluid inks, pigment content in the ink can readily be varied at press-side to accomplish the effect of delivering more or less coloration (pigment) to the substrate being printed. When using viscous oil-based lithographic inks, press-side alteration of the ink is generally not an acceptable alternative for practical operational reasons.

Changing to a metering roller having larger or smaller ink delivery capacity is another alternative for changing the ink input quantity and therefore the pigment delivery quantity, which therefore changes the printed optical density. This requires designing the press with quick-roller change capability as a criterion, often at the sacrifice of other machine or operational design options. Also, the metering rollers for large, high-speed presses are heavy, requiring mechanical lifting assistance devices. Such changes are generally not sufficiently rapid for use in high-speed, high volume printing operations. Means are needed to avoid these impractical means for modulation of keyless inking printed optical density values.

The present invention overcomes the problems, difficulties and inconveniences associated with fixed volume ink input systems, yet retains all of the principles essential to keyless lithographic systems as disclosed in U.S. Pat. No. 4,690,055. Accordingly, in this improvement a variable thickness ink or printing fluid film is metered past a doctor blade or equivalent structure. A separate device is provided for removing the return ink film.

SUMMARY OF THE INVENTION

An object of the present invention is to provide a keyless lithographic printing system having an improved printing fluid input means.

Another object of this invention is to provide simple keyless inking means for modulating in a uniform cross-press manner the amount of ink being input to a printing press.

Still another object is to provide improved control of ink input uniformity in scraped keyless inking systems.

It is another object of the present invention to provide a metering system which is ultrasonically vibrated to control the thickness of an ink or printing fluid film being applied to the surface of a metering or receiving roller.

In one embodiment the objects are achieved by an improved printing fluid input system for use in a keyless lithographic printing press of the type having blanket cylinder, plate cylinder with printing plate mounted thereon, one or more form rollers, optionally an inking train of two or more inking rollers, and a system for supplying dampening solution to the printing plate. A metering roller in the press inking system of rollers has an oleophilic and hydrophobic surface capable of retaining a quantity of the printing fluid. A reverse angle doctor blade is mounted coextensively with the metering roller to remove by scraping all excess ink or printing fluid from the metering roller surface.

In general terms, the present invention is an ultrasonic ink input apparatus for use in a keyless lithographic printing press, having the following elements: rotatable metering roller having at least an oleophilic and hydrophobic surface; means for providing a source of ink; means for applying a thin film of ink to the surface of the metering roller, the means for applying having at least one means for imparting ultrasonic vibrations to the means for applying the thin ink film such that the thickness of the thin film of ink is a function of the amplitude of the ultrasonic vibrations, the means for applying a thin film of ink being connected to the means for providing a source of ink; the means for varying the amplitude of ultrasonic vibrations being connected to the means for imparting ultrasonic vibrations.

One means for applying a thin film of ink has a metering blade having a first end positioned adjacent the oleophilic and hydrophobic surface of the metering roller and a second fixed end. The means for imparting ultrasonic vibrations has at least one piezoelectric transducer attached to the metering blade. The second fixed end of the metering blade can be attached to a stationary support via a means for decoupling the ultrasonic vibrations from the support and the piezoelectric transducer can be attached to the metering blade, for example adjacent the second fixed end of the metering blade.

The means for imparting ultrasonic vibrations can be one or a plurality of piezoelectric transducers attached to the metering blade, for instance, in a side-by-side arrangement, or the means for varying the amplitude or strength of ultrasonic vibrations has means for individually or collectively adjusting the power input of operation to the piezoelectric transducers.

The ultrasonic ink input apparatus further has means for substantially removing the return ink film on the oleophilic and hydrophobic surface of the metering roller.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures in which like reference numerals identify like elements, and in which:

DESCRIPTION OF THE PREFERRED EMBODIMENT

Figure 1:
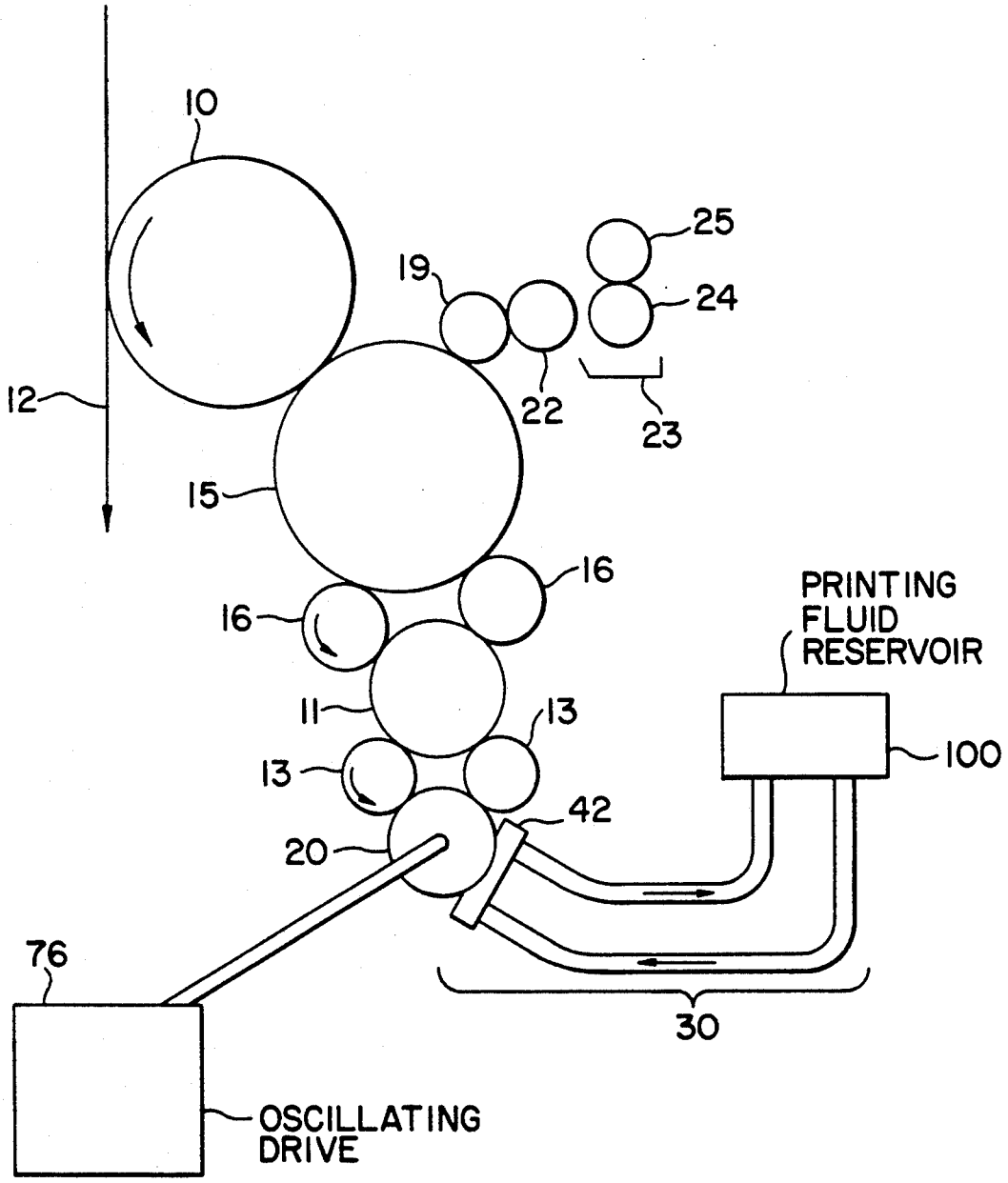
FIG. 1 is a schematic side view of a keyless lithographic printing press system in accordance with the present invention.

One embodiment of a keyless inking system incorporating the present invention is depicted in FIG. 1 in which a blanket cylinder 10 prints on a web traveling as indicated by the directional arrow 12. Referring first to the dampening and printing fluid input systems associated with blanket cylinder 10, a plate cylinder 15 is contacted by two form rollers 16 which are in turn contacted by a metering roller 20 via copper drum 11 and two transfer rollers 13. Although a smooth or moderately textured metering roller can be used with the present invention, the ink metering roller 20 may advantageously be of the type disclosed in U.S. Pat. Nos. 4,862,799, 4,882,990, 4,537,127, 4,567,827 or 4,601,242 which were cited previously. In the dampening arrangement associated with plate cylinder 15 there typically is provided a rubber dampener form roller 19 and, for instance, a copper covered or a chrome covered oscillating transfer roller 22. The water is contained in a pan tray 23 and a pan roller 24 is used to pick up water from the pan 23 to bring it into contact with a spiral brush roller 25 that is rotating in a direction opposite to the direction of rotation of pan roller 24. It should be recognized that virtually any known dampening system can be used with this embodiment of the present invention.

With this or other arrangements dampening solution is transferred onto the transfer roller 22 and from there to the dampener form roller 19. In the FIG. 1 embodiment the form roller 19 is positioned in a water-first sequence so that, during each revolution of the press subsequent to transferring image-formulated printing fluid to the blanket cylinder 10, for transfer to the paper, plates are first subjected to dampening solution from the dampener form roller 19 before renewed printing fluid is applied to the imaged surface of the plates by means of the rubber covered form rollers 16.

The printing fluid input system that is used to supply printing fluid to the plate and blanket cylinders 15, 10, makes it possible to supply a uniform mixture of ink and naturally occurring dampening solution to the plate cylinder 15 and thereby maintain the high print quality characteristic of conventional lithography. In this arrangement the printing fluid source is identified generally by the numeral 30 and is used to deliver ink containing dampening solution, also referred to as the printing fluid, to the metering roller 20. Dampening solution in this system is not deliberately added to the ink in this embodiment, but rather results naturally from printing fluid comprised predominantly of ink coming in contact with dampening solution on the printing plate cylinder 15 and which, by means of the unused or return portion of printing fluid that passes or transfers back down through the various rollers, in part eventually enters the printing fluid input system 30.

The present invention can be used not only with the FIG. 1 printing press configuration, but also with most other keyless inking press configurations.

Figure 2:
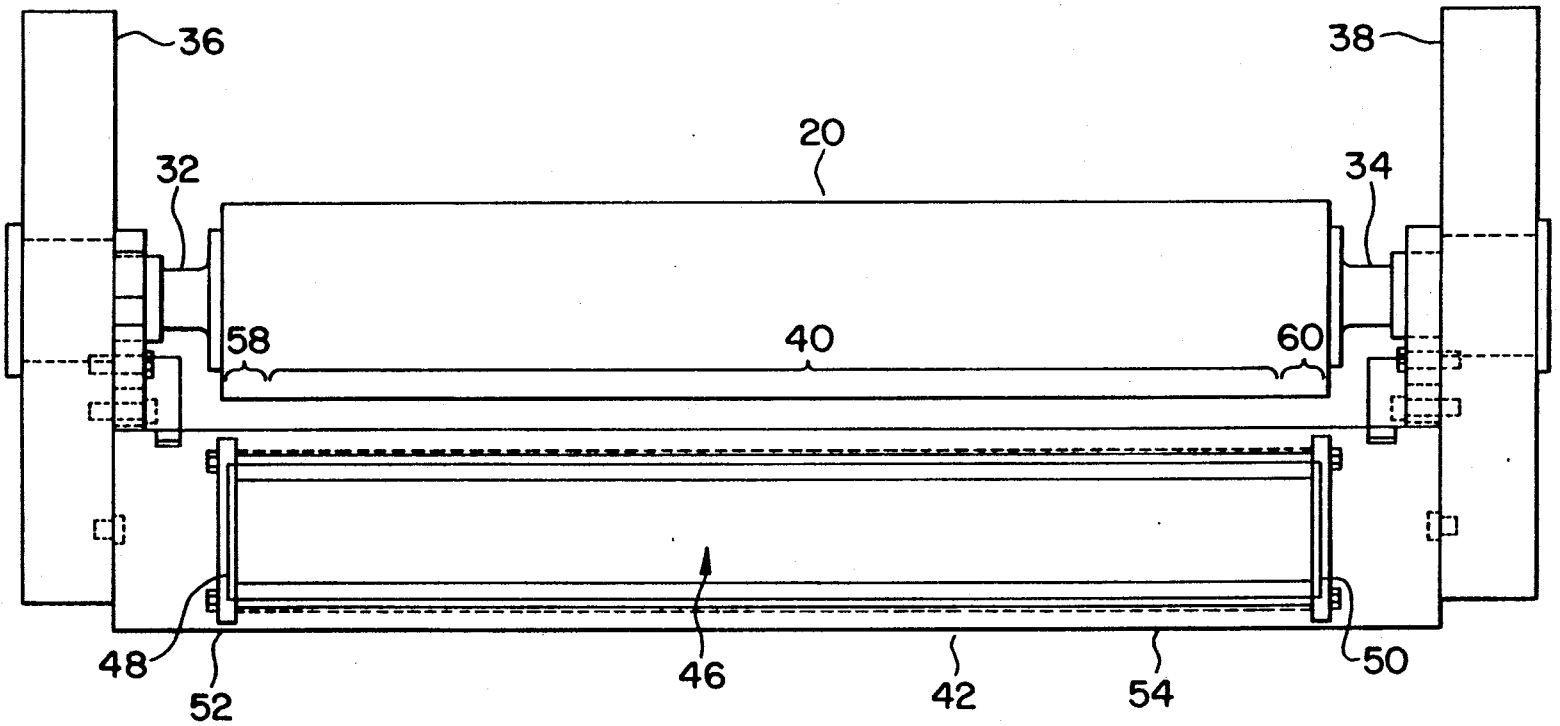
FIGS. 2 and 3 are plan and elevation views, respectively, of one form of pressurized printing fluid input apparatus useful in the practice of the present invention and of a metering roller.
Figure 3:
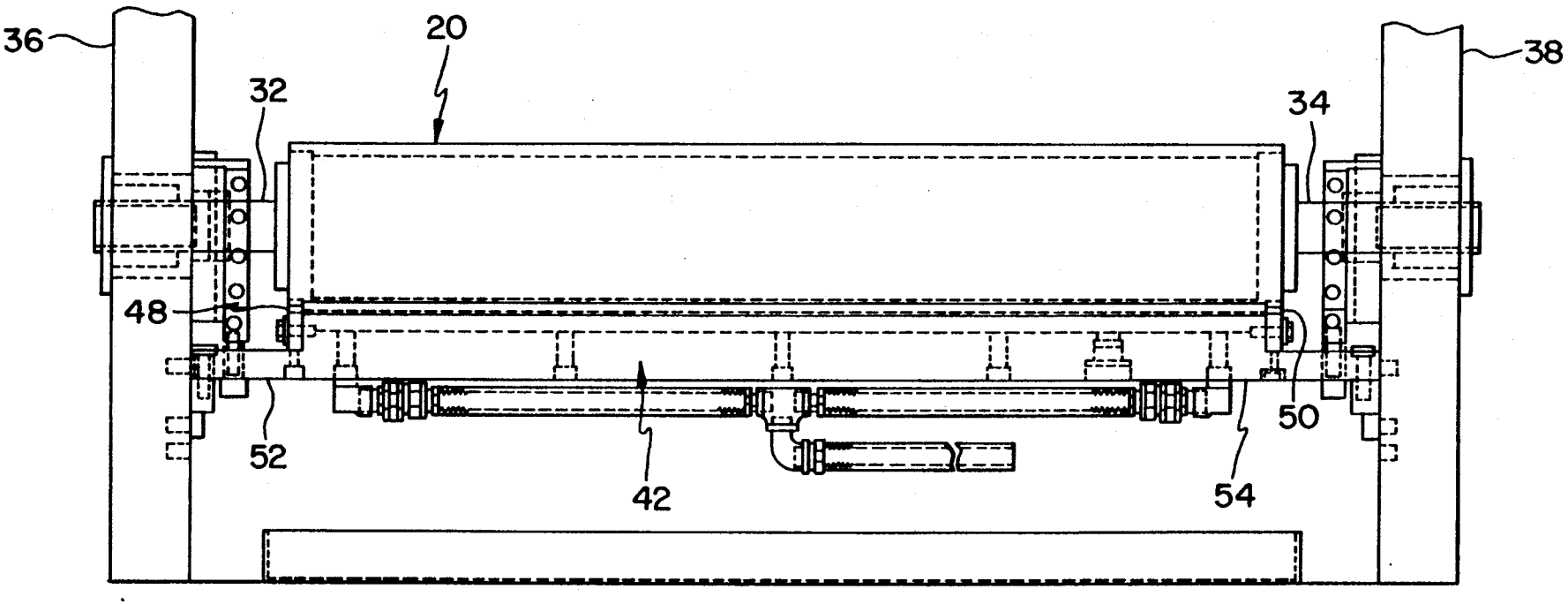
Figure 4:
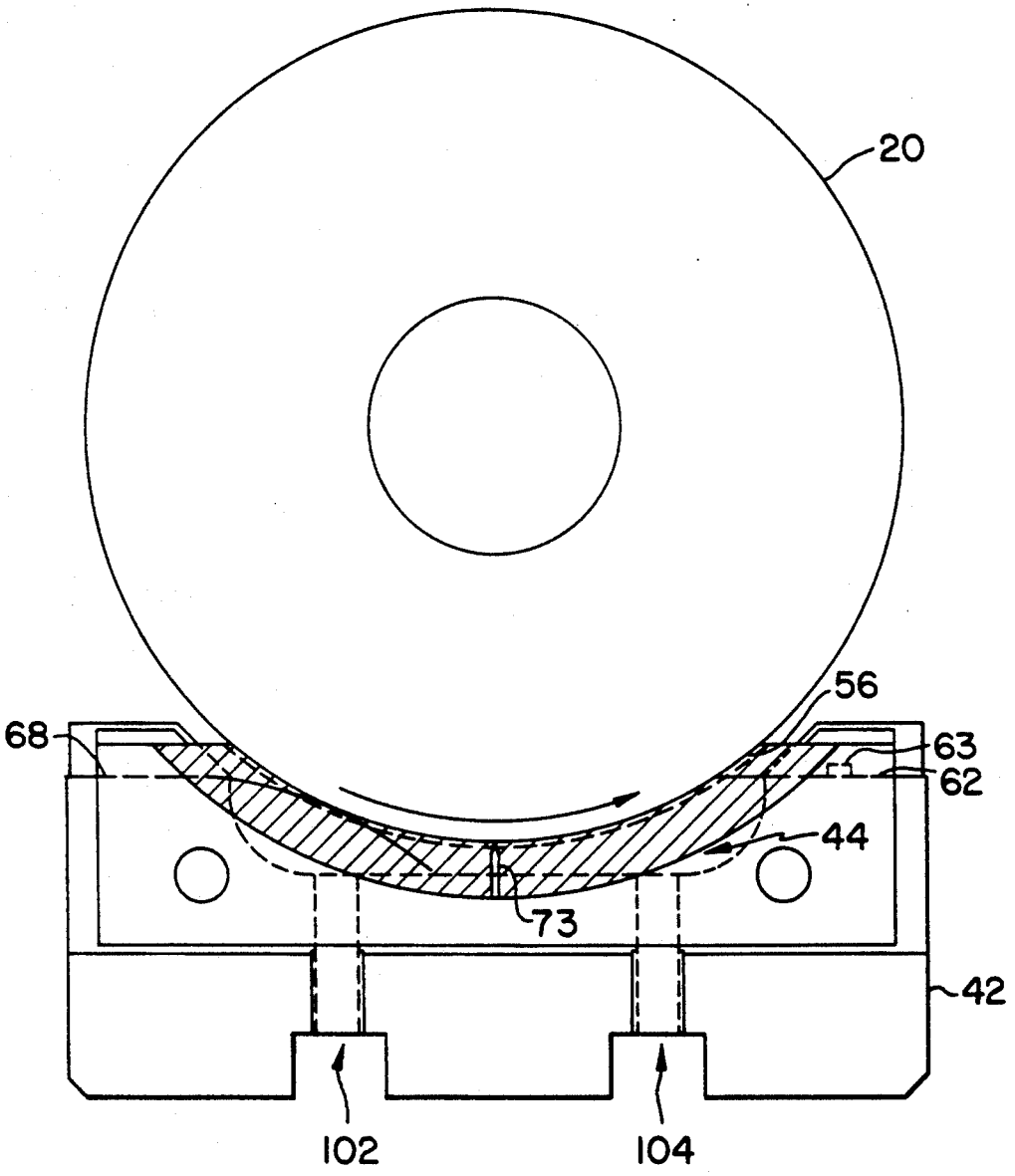
FIG. 4 is an end view of the printing fluid input apparatus of FIGS. 2 and 3 and the metering roller.

The printing fluid input apparatus of the system 30 is depicted in an open servicing position relative to the metering roller 20 in FIGS. 2 and 3. An end view of the apparatus engaged with the metering roller 20 in a closed operating position is depicted in FIG. 4. The metering roller 20 has first and second ends 32 and 34 which rotate in frames 36 and 38, respectively. The metering roller 20 has a surface 40 intermediate the first and second ends 32 and 34, the surface 40 capable of retaining a quantity of printing fluid. A housing 42 has an open first side 46 which mates with at least a portion of the surface 40 of the metering roller 20. When the housing 42 is in the closed operating position a chamber 44 is formed which contains the printing fluid under a predetermined pressure.

At least first and second end seal assemblies 48 and 50 are mounted on first and second opposed ends 52 and 54, respectively, of the housing 42. Each of the first and second end seal assemblies 48 and 50 have at least a first surface 56 for mating with first and second end sections 58 and 60, respectively, of the metering roller 20.

Referring now also to FIG. 4 a reverse angle doctor blade 62 is attached to a second side 64 of the housing 42 and has an edge 66 for applying a thin film of printing fluid to the surface 40 of the metering roller 20 by removing excess printing fluid adhering to the surface 40 as the metering roller 20 rotates past the printing fluid filled chamber 44. The thickness of the thin film of printing fluid is a function of the frequency of vibrations imparted to the reverse angle doctor blade 62 by at least one piezoelectric transducer 63 attached thereto. A sealing member 68 is attached to a third side 70 of the housing 42 and has a surface area 72 for substantially sealing the chamber 44, at least the surface area 72 of the sealing member 68 being adjacent the surface 40 of the metering roller 20 such that an edge 74 of the sealing member 68 extends into the chamber 44. The sealing member 68 is substantially longer and more flexible than the reverse angle doctor blade 62.

Since the printing fluid in the chamber 44 is under pressure the reverse angle doctor blade 62 is held against the surface 40 of the metering roller 20 at least in part by this pressurized printing fluid in the chamber 44.

It is well known in the art of printing presses to provide devices which cause selected rollers or cylinders to oscillate (for example the roller oscillation drive disclosed in Goss Metroliner Parts Catalog No. 280-PC, Figure 280-56). In the present invention such a means for oscillating 76 can be attached to the metering roller 20, thus providing oscillation to the metering roller 20, while the housing 42 of the printing fluid input apparatus 30 remains stationary. The metering roller 20 is of the type having an oleophilic and hydrophobic surface. Depending upon the application it may or may not be necessary to provide oscillation to the metering roller 20. However, in those applications where it is desirable to provide oscillation to the metering roller 20 it is feasible to accomplish this with the printing fluid input apparatus of the present invention.

The sealing member 68 may, for instance, be formed of steel or plastic and have a width in the range of approximately 1 to 2 inches and a thickness in the range of approximately 0.004 to 0.01 inch selected as a function of the open first side dimension of the housing 42 and of the diameter of the metering roller 20 which mates with the open first side, such that the sealing member 68 properly seals the chamber 44. The reverse angle doctor blade 62 may be formed of steel or plastic and in general have a width of approximately 1 inch and a thickness in the range of approximately 0.004 to 0.01 inch, if steel, and 0.04 to 0.06 inch, if plastic.

The printing fluid input apparatus further includes at least one inlet means 102 in the housing 42 for inputting printing fluid into the chamber 44 and at least one outlet means 104 in the housing 42 for outputting printing fluid from the chamber 44. Since the chamber 44 is sealed by the metering roller 20, the first and second end assemblies 48 and 50, the reverse angle doctor blade 62 and the sealing member 68, it is thus possible to keep the printing fluid under a predetermined pressure. A circulating system can be used to pump the printing fluid from a printing fluid reservoir 100 to the housing 42.

Figure 5:
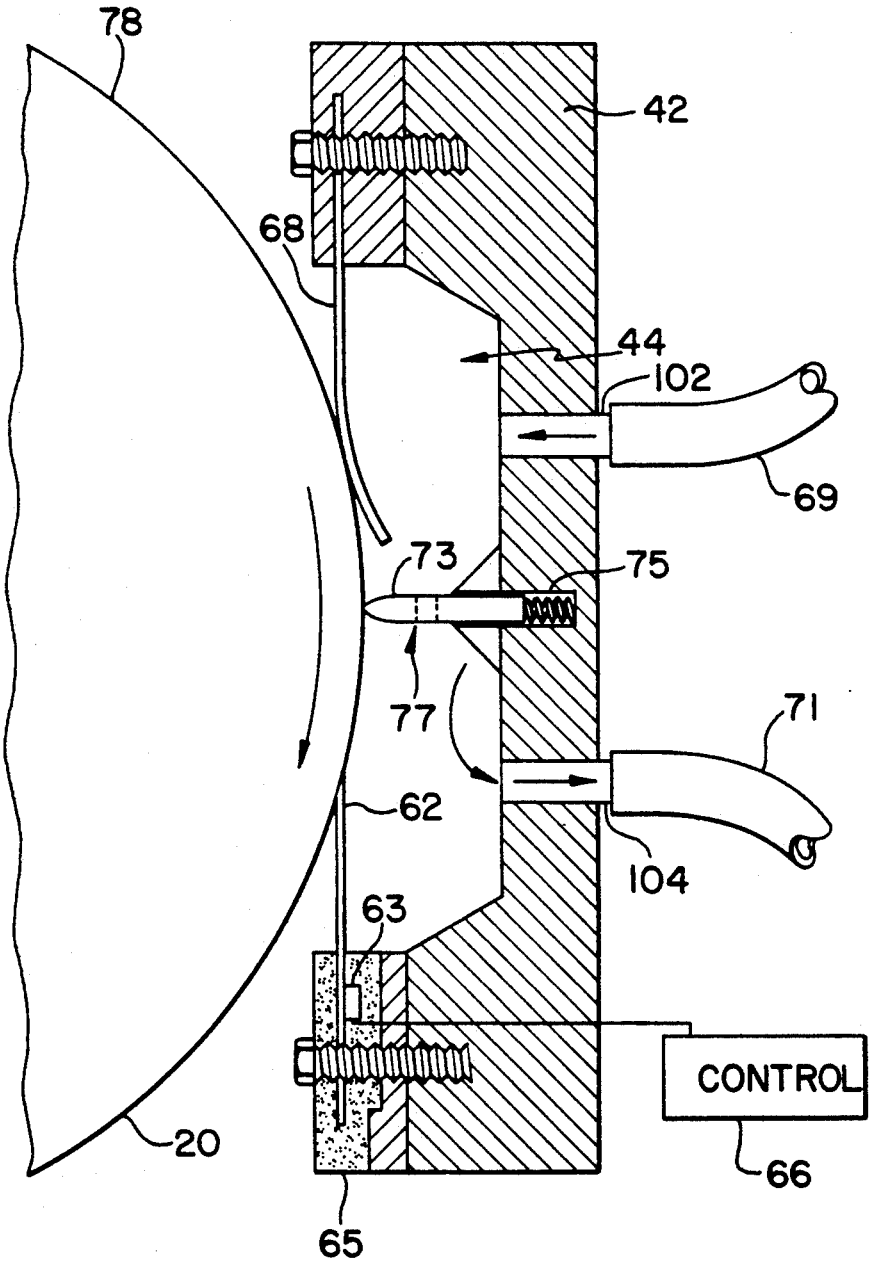
FIG. 5 is a cross-sectional internal view of one embodiment of FIGS. 1 thru 4 printing fluid input apparatus of the present invention.

As shown in more detail in FIG. 5 the reverse angle doctor blade 62 is attached to the housing 42 of the printing fluid input apparatus by means of ultrasonic decoupling or dampening material 65. The piezoelectric transducer 63 is attached to the reverse angle doctor blade 62 to allow transfer of the transducers vibration to the blade and is also contained within decoupling material 65. The piezoelectric transducer 63 is electrically connected to a control source 66 for providing power to the piezoelectric transducer 63. The piezoelectric transducer 63 imparts ultrasonic vibrations to the reverse angle doctor blade 62. The control 66 varies the voltage to the piezoelectric transducer 63 in order to vary the amplitude or strength of the ultrasonic vibrations on the reverse angle doctor blade 62 thereby changing the time-average tightness of contact between the blade and metering roller, which modifies the thickness of the thin film of printing fluid emerging on the metering roller 20 from the ultrasonic apparatus 42. As explained in more detail below, the viscosity of lithographic printing fluids decreases with increase in ultrasonic vibration amplitude, that is with increase in the power of the ultrasonic vibrations. Thus with the present invention it is possible to control the thickness of the thin film of printing fluid being metered to the surface of the metering roller 20.

One elongated piezoelectric transducer 63 can be attached to the reverse angle doctor blade 62 or a plurality of piezoelectric transducers 63 ca be attached to the reverse angle doctor blade 62 across a width of the blade 62. The best combination can be determined by experimentation so that the ultrasonic power is uniformly applied (cross-press) to all portions of the blade. It is important to point out that although the present invention can operate with a metering roller 20 of the type having a celled or engraved or textured surface, the present invention also can operate with a metering roller 20 having a relatively smooth surface, as long as the roller surface is oleophilic and hydrophobic.

In the embodiment shown in FIG. 5, ink is fed through the cavity 44 in the housing 42 by means of lines 69 and 71 which are attached respectively to the input port 102 and the output port 104. The interior of the cavity 44 has a coarse, stiff, doctoring element 73 that is held in place against the surface of the metering roller 20 by for instance spring 75. In order to allow the ink to circulate within the cavity 44 the element 73 is provided with slots 77. The element 73 provides that the return printing fluid film 78 which can act as a boundary layer to disallow cohesive pick up of replacement ink is substantially removed or at least substantially disturbed, assuring that return printing fluid is mixed with fresh circulating printing fluid continuously. The element 73 helps to assure that within the cavity the variable composition return ink is removed, homogenized with fresh circulating printing fluid and that a uniform composition film is available at the ultrasonically activated portion of the cavity, that is, at the location of the reverse angle metering doctor blade 62.

Figure 6:
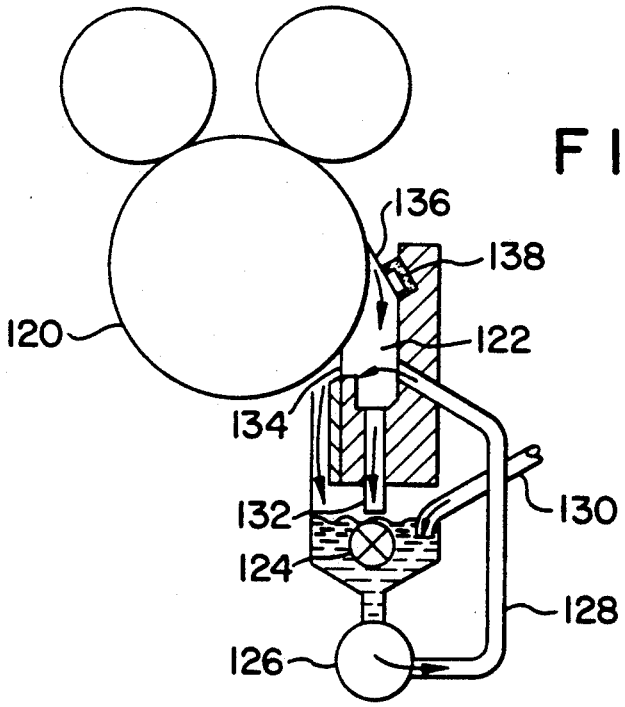
FIG. 6 is a schematic side view of an alternative embodiment having a pressurized printing fluid input chamber.

The ultrasonically modulated metering blade concept of the present invention can also be utilized in other press configurations and printing fluid input systems. For example, as depicted in FIG. 6, printing fluid is supplied to a cavity 122 in a housing 124 via a circulating system comprising a mixer 124 connected to a pump 126 with a return line 128 connected to the housing 124. Fresh printing fluid is supplied for replacement via line 130 and outlet 132 collects printing fluid from the cavity 122 for the circulating system. A stiff doctor blade 134 is provided which substantially removes the return printing fluid from the surface of the metering roller 120 and the ultrasonically modulated trailing metering blade 136 is provided with at least one piezoelectric transducer 138 and operates as described above.

Figure 7:
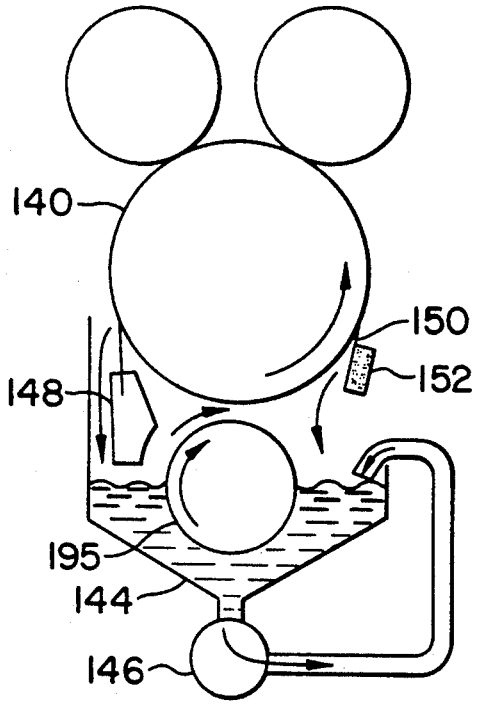
FIG. 7 is a schematic side view of an alternative embodiment having a trailing ultrasonically modulated metering blade.

FIG. 7 shows another embodiment of the present invention in which the metering roller 140 receives printing fluid from a pan roller 142 in printing fluid reservoir 144. A pump 146 recirculates the printing fluid back to the reservoir 144. A reverse angle scraping blade 148 removes the return printing fluid film which is returned to the printing fluid reservoir 144. The ultrasonically modulated metering blade 150 of the present invention is provided for operating with the metering roller 140 to remove excess printing fluid supplied by reservoir roller 145 to the metering roller 140 which excess is also returned to the reservoir 144 and which metering blade 150 is vibrated by the piezoelectric transducer 152 as described above to provide a controlled thickness to the film of printing fluid being metered onto the surface of the metering roller 140.

Figure 8:
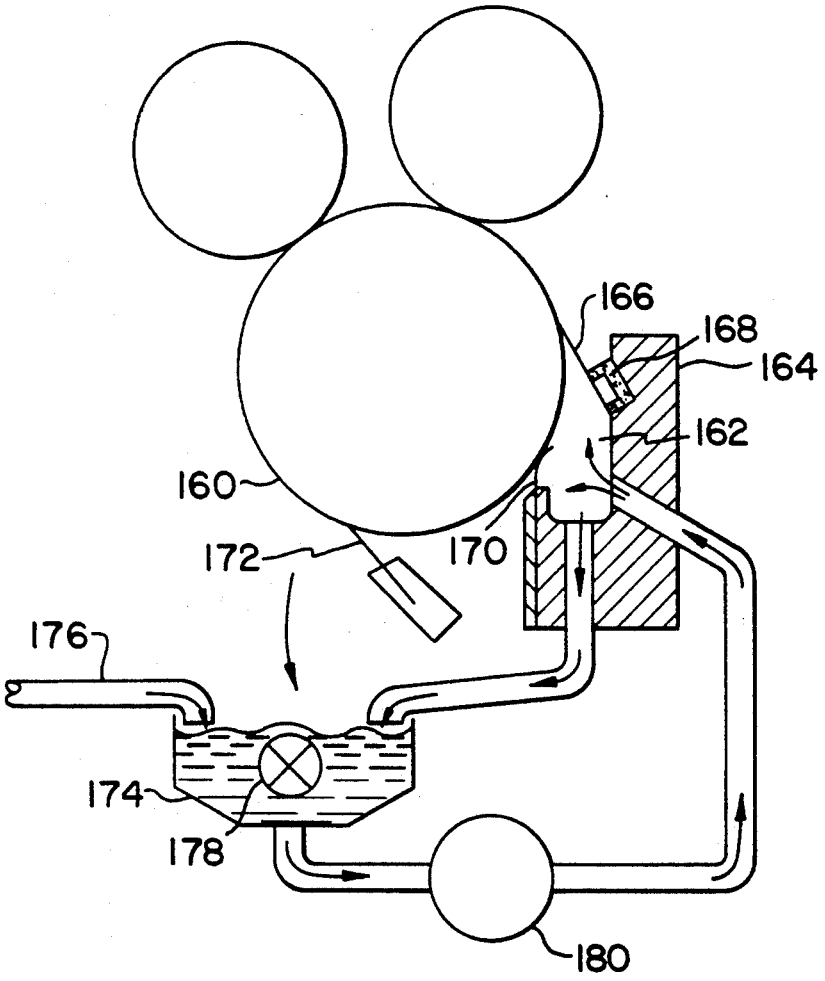
FIG. 8 is a schematic side view of another alternative embodiment having a separate scraping blade for removing a return ink on the metering roller.

FIG. 8 depicts yet another embodiment of the present invention in which the metering roller 160 is provided with printing fluid from a cavity 162 in a housing 164 which has on one end the ultrasonically modulated fixed position trailing metering blade 166 of this invention that is vibrated by piezoelectric transducer 168 and has on the other end a flexible non-scraping sealing blade 170. A second scraping blade 172 is provided for removing the return film of printing fluid which is returned to printing fluid reservoir 174. Replacement printing fluid is provided through line 176 to the printing fluid reservoir 174 wherein a mixer 178 can be provided for homogenizing the printing fluid. Pump 180 transfers printing fluid from the printing fluid reservoir 174 to the cavity 162 in the housing 164. As in the other embodiments described above the piezoelectric transducer 168 imparts ultrasonic vibrations to the trailing metering blade 166. The amplitude of ultrasonic vibrations together with the geometric conditions of the doctor blade and metering roller influence determine the thickness of printing fluid film printing fluid metered onto the surface of the metering roller 160.

Figure 9:
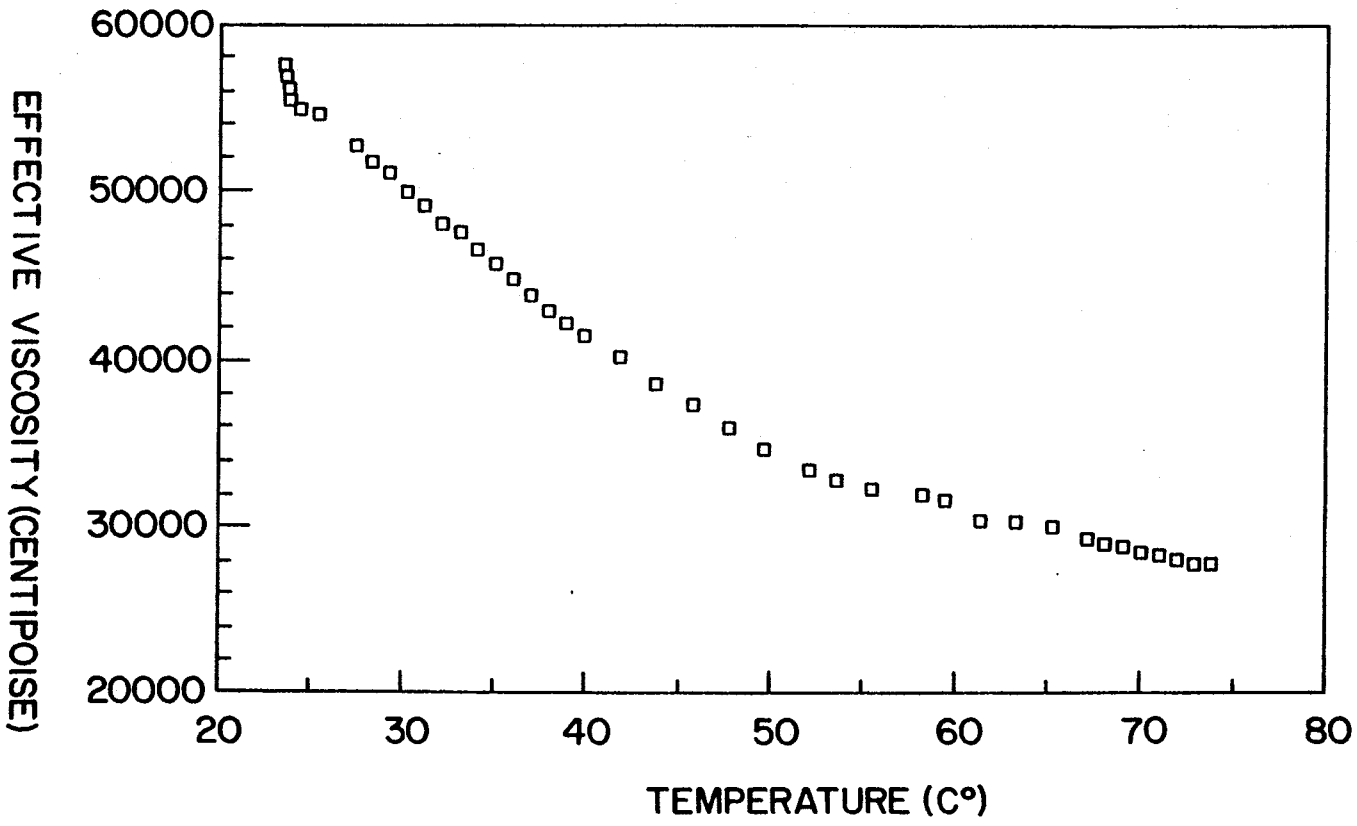
FIG. 9 is a graph of ink viscosity vs. temperature.
Figure 10:
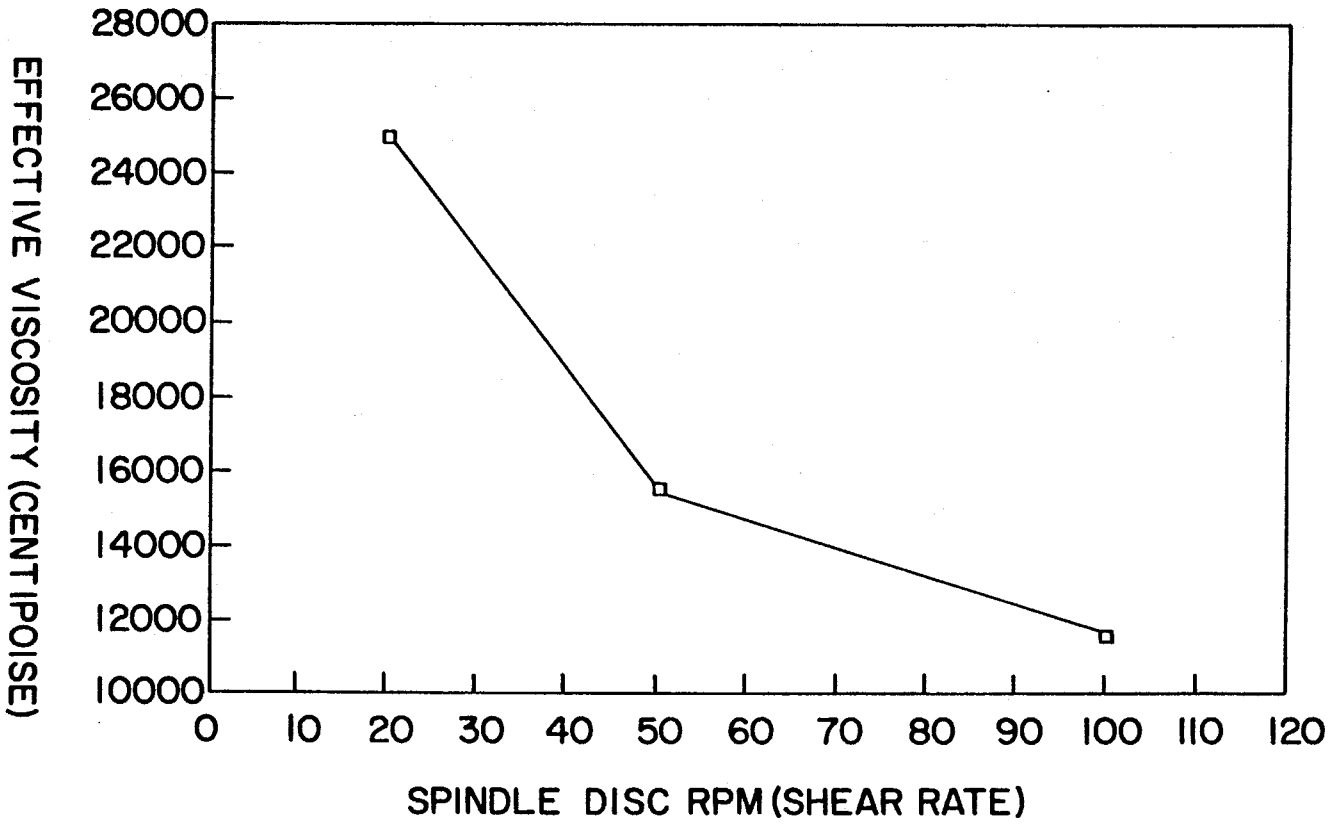
FIG. 10 is a graph of ink viscosity vs. shear rate applied to a ink.
Figure 11:
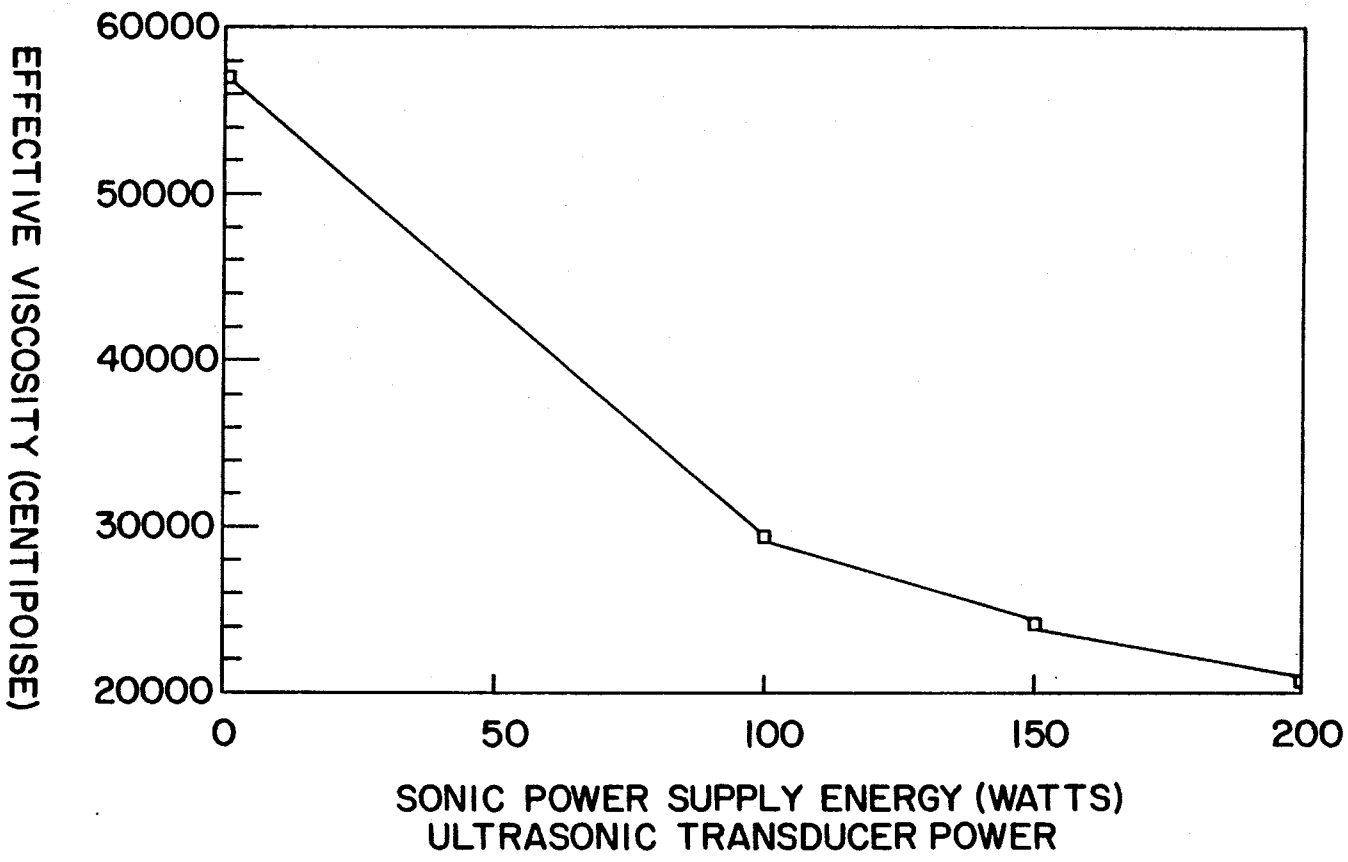
FIG. 11 is a graph of ink viscosity vs. applied transducer power.

It is well known in the prior art that ink or printing fluid viscosity changes as a function of temperature as well in response to applied shearing forces. For example, FIG. 9 depicts viscosity change as a function of temperature for a particular printing ink and FIG. 10 depicts viscosity change as a function of revolutions per minute of a rotating disk viscometer, that is, the rate of shearing of the ink. As can be seen from the data the ink viscosity decreases as the shearing rate is increased. Thus the viscosity of the ink can be changed by imparting motion to the ink, and it has been discovered that by subjecting the ink to high intensity ultrasonic vibration frequencies a viscosity reduction similar in magnitude to typical shearing force rates can be obtained. FIG. 11 depicts the decrease in printing ink viscosity as a function of power applied to a 20 kHz ultrasonic probe. These data shows that the application of approximately 200 watts of electrical power to the 20 kHz ultrasonic probe reduces the printing fluid solution viscosity to a value that is less than if heat comparable to a 70° C. increase in temperature were applied (see FIG. 9).

The invention is not limited to the particular details of the apparatus and method depicted and other modifications and applications are contemplated. Certain other changes may be made in the above described apparatus and method without departing from the true spirit and scope of the invention herein involved. For example, it is envisioned that frequencies of vibration outside of the normal ultrasonic frequency range could be utilized within the spirit of the present invention and devices suitable for imparting such frequencies of vibration could be used instead of piezoelectric transducers. It is intended, therefore, that the subject matter in the above depiction shall be interpreted as illustrative and not in a limiting sense.

What is claimed is:

1. An ultrasonic printing fluid input apparatus for use in a lithographic printing press, comprising:

a rotatable roller having at least an oleophilic and hydrophobic surface;

means for providing a source of printing fluid;

means for applying a thin film of printing fluid to the surface of the roller, with the applying means having at least one means for imparting ultrasonic vibrations to the applying means such that the thickness of said thin film of printing fluid is a function of the amplitude of ultrasonic vibrations, with the applying means being connected to the providing means;

means for varying the amplitude of ultrasonic vibrations connected to the imparting means, with the applying means having a blade having a first end positioned adjacent to the oleophilic and hydrophobic surface of the roller, and a second remote end, and with the imparting means having at least one piezoelectric transducer attached to said blade; and means for urging said first end of the blade against said surface of the roller such that said ultrasonic vibrations produce a time-average tightness of contact between said first end of the blade and said surface of the roller, with said first end of the blade periodically substantially contacting said surface of the roller, and with the second end of the blade being attached to a support via a means for decoupling the ultrasonic vibrations.

2. A printing fluid apparatus, comprising:

a rotatable roller having an outer surface;

a housing having an open side which mates with at least a portion of said surface of said roller to define a closed chamber substantially filled with said printing fluid under a predetermined pressure;

at least first and second means for end sealing mounted on opposed ends of the housing, with each of said first and second means for end sealing slidably engaging said roller;

means for applying a thin film of printing fluid on said surface of said roller as said roller rotates past said chamber containing said printing fluid, said applying means being attached to the housing and having at least a first edge adjacent said surface of the roller, said applying means having attached thereto means for imparting ultrasonic vibrations to the applying means such that a thickness of said thin film is a function of the amplitude of ultrasonic vibrations, said pressurized printing fluid urging said first edge of the applying means against said surface of the roller such that the imparting means produces a time-average tightness of contact between said first edge and said surface, with said first edge periodically substantially contacting said surface of the roller;

means for surface sealing attached to the housing opposed from said applying means, with said means for surface sealing having a surface area for substantially sealing said chamber, and with the surface area being substantially adjacent said surface of the roller; and at least one inlet means in the housing for inputting said printing fluid into said chamber and at least one outlet means in said housing for outputting printing fluid from said chamber, with said inlet means and said outlet means being connected to a means for pressurizing and circulating said printing fluid.

3. A method for inputting printing fluid for use in a lithographic printing press, comprising the steps of:

providing a rotatable roller having at least an oleophilic and hydrophobic surface;

providing a source of fluid;

providing means for applying a thin film of printing fluid to the surface of the roller, said applying means having a blade having a first end positioned adjacent the surface of the roller and a second end attached to a support;

imparting ultrasonic vibrations to the blade by means such that the thickness of said thin film of printing fluid is a function of the amplitude of ultrasonic vibrations, with the applying means being connected to said source of printing fluid;

varying said ultrasonic vibrations in an amplitude range of operation;

urging said first end of the blade against said surface of the roller by means of said printing fluid such that said ultrasonic vibrations produce a time-average tightness of contact between said first end and said surface of the roller, with said first end periodically substantially contacting said surface of the roller; and decoupling the ultrasonic vibrations in the roller from the support, wherein at least the amplitude of operation of imparting ultrasonic vibrations determines the quantity of printing fluid applied to the roller by said applying means.

* * * * *